US011522295B2

(12) United States Patent
Wu et al.

(10) Patent No.: US 11,522,295 B2
(45) Date of Patent: Dec. 6, 2022

(54) ANTENNA STRUCTURE

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Cheng-Hsiung Wu, Taipei (TW); Ching-Hsiang Ko, Taipei (TW); Yi-Ru Yang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 303 days.

(21) Appl. No.: 17/039,065

(22) Filed: Sep. 30, 2020

(65) Prior Publication Data

US 2021/0175631 A1 Jun. 10, 2021

(30) Foreign Application Priority Data

Dec. 5, 2019 (TW) ..... 108144556

(51) Int. Cl.
*H01Q 13/16* (2006.01)
*H01Q 1/48* (2006.01)
*H01Q 21/06* (2006.01)

(52) U.S. Cl.
CPC ..... *H01Q 13/16* (2013.01); *H01Q 1/48* (2013.01); *H01Q 21/06* (2013.01)

(58) Field of Classification Search
CPC . H01Q 1/38; H01Q 9/0414; H01Q 5/371–392
See application file for complete search history.

(56) References Cited

U.S. PATENT DOCUMENTS

2016/0134017 A1* 5/2016 Lin ..... H01Q 5/335 343/861

FOREIGN PATENT DOCUMENTS

| | | |
|---|---|---|
| CN | 103390793 | 11/2013 |
| CN | 104269609 | 1/2015 |
| TW | 201832414 | 9/2018 |
| TW | I658650 | 5/2019 |

* cited by examiner

*Primary Examiner* — Ricardo I Magallanes
(74) *Attorney, Agent, or Firm* — J.C. Patents

(57) ABSTRACT

An antenna structure includes first, second, and third radiators. The first radiator includes first, second, and third segments. One end of the first segment includes a signal feeding end. The second and third segments respectively extend in opposite directions from another end of the first segment. The second radiator includes a fourth segment, a fifth segment, and a sixth segment extending from an intersection of the fourth and fifth segments. The fourth segment includes a first ground end. The fifth segment includes a second ground end. A first slit is between the second and sixth segments; a second slit is between the third, fourth, and sixth segments. The third radiator includes seventh and eighth segments connected to each other in a bending manner. The seventh segment includes a third ground end. A third slit is between the first and seventh segments and between the third and eighth segments.

11 Claims, 8 Drawing Sheets

ANTENNA STRUCTURE

CROSS-REFERENCE TO RELATED APPLICATION

This application claims the priority benefit of Taiwan application no. 108144556, filed on Dec. 5, 2019. The entirety of the above-mentioned patent application is hereby incorporated by reference and made a part of this specification.

BACKGROUND

Technical Field

The disclosure relates to an antenna structure, and in particular, to a multi-band antenna structure.

Description of Related Art

Currently, most existing LTE antennas are composed of a low frequency (698 MHz to 960 MHz) antenna and a high frequency (1710 MHz to 2700 MHz) antenna. In order to meet the demand, an antenna capable of providing a plurality of frequency bands has drawn attention in the pertinent research field.

SUMMARY

The disclosure provides an antenna structure that can provide a plurality of frequency bands.

An embodiment of the disclosure provides an antenna structure that includes a first radiator, a second radiator, and a third radiator. The first radiator includes a first segment, a second segment, and a third segment, and one end of the first segment includes a signal feeding end. The second segment and the third segment extend in opposite directions from the other end of the first segment. The second radiator includes a fourth segment, a fifth segment, and a sixth segment that extends from an intersection of the fourth segment and the fifth segment. The fourth segment includes a first ground end, and the fifth segment includes a second ground end. The first ground end and the second ground end are away from the intersection. A first slit is formed between the second segment and the sixth segment, and a second slit is formed among the third segment, the fourth segment, and the sixth segment. The third radiator includes a seventh segment and an eighth segment connected to each other in a bending manner. Here, the seventh segment includes a third ground end, and a third slit is between the first segment and the seventh segment and between the third segment and the eighth segment.

In view of the foregoing, the antenna structure provided in one or more embodiments of the disclosure is grounded in a multi-path manner through the first ground end, the second ground end, and the third ground end, and a plurality of frequency bands are coupled by adopting a capacitive coupling design of the first slit, the second slit, and the third slit.

BRIEF DESCRIPTION OF THE DRAWINGS

Reference will now be made in detail to the embodiments of the disclosure, examples of which are illustrated in the accompanying drawings. Wherever possible, the same reference numbers are used in the drawings and the description to refer to the same or like parts.

DESCRIPTION OF THE EMBODIMENTS

Figure 1:
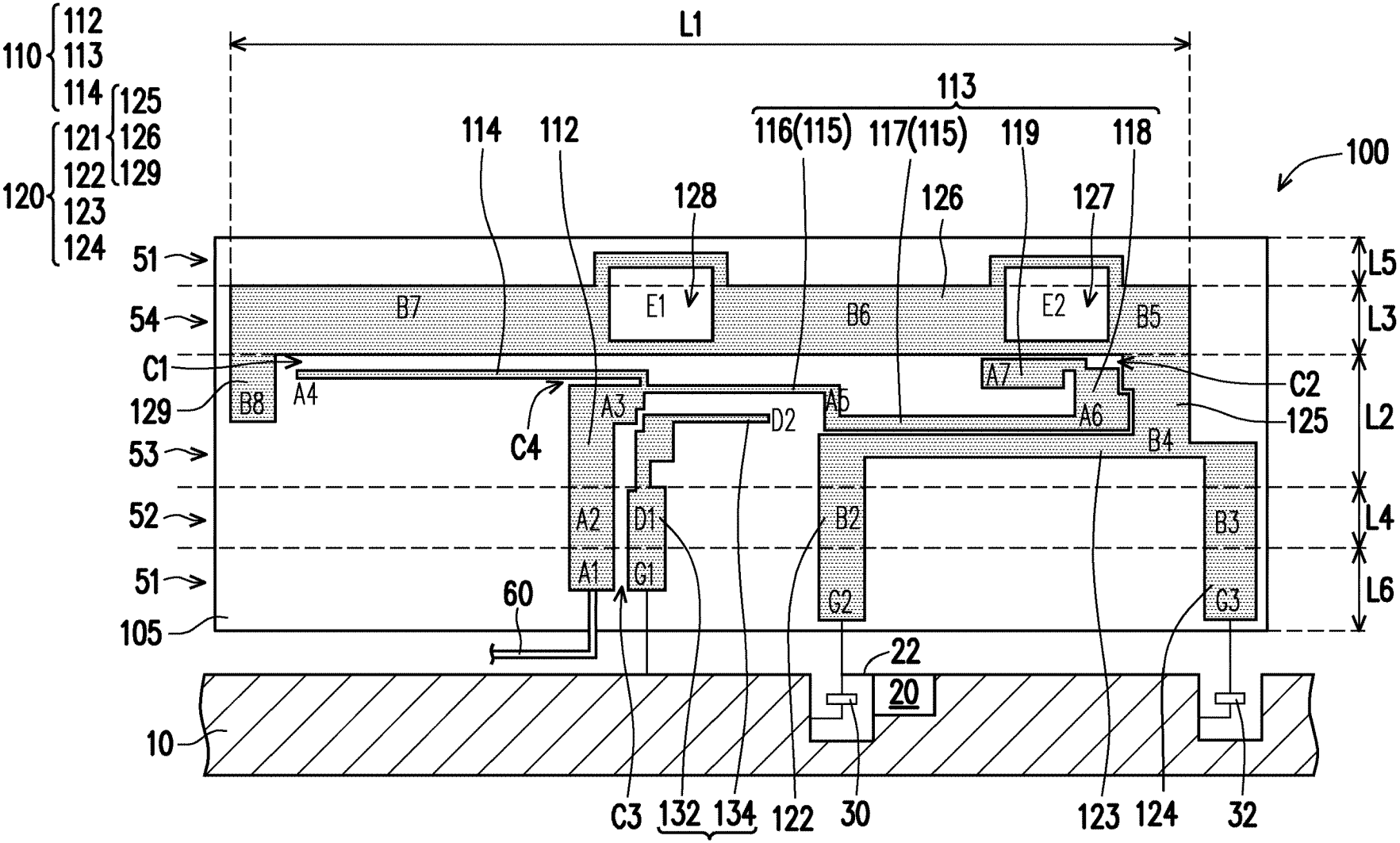
FIG. 1 is a schematic diagram of an unfolded antenna structure according to an embodiment of the disclosure.
Figure 2A:
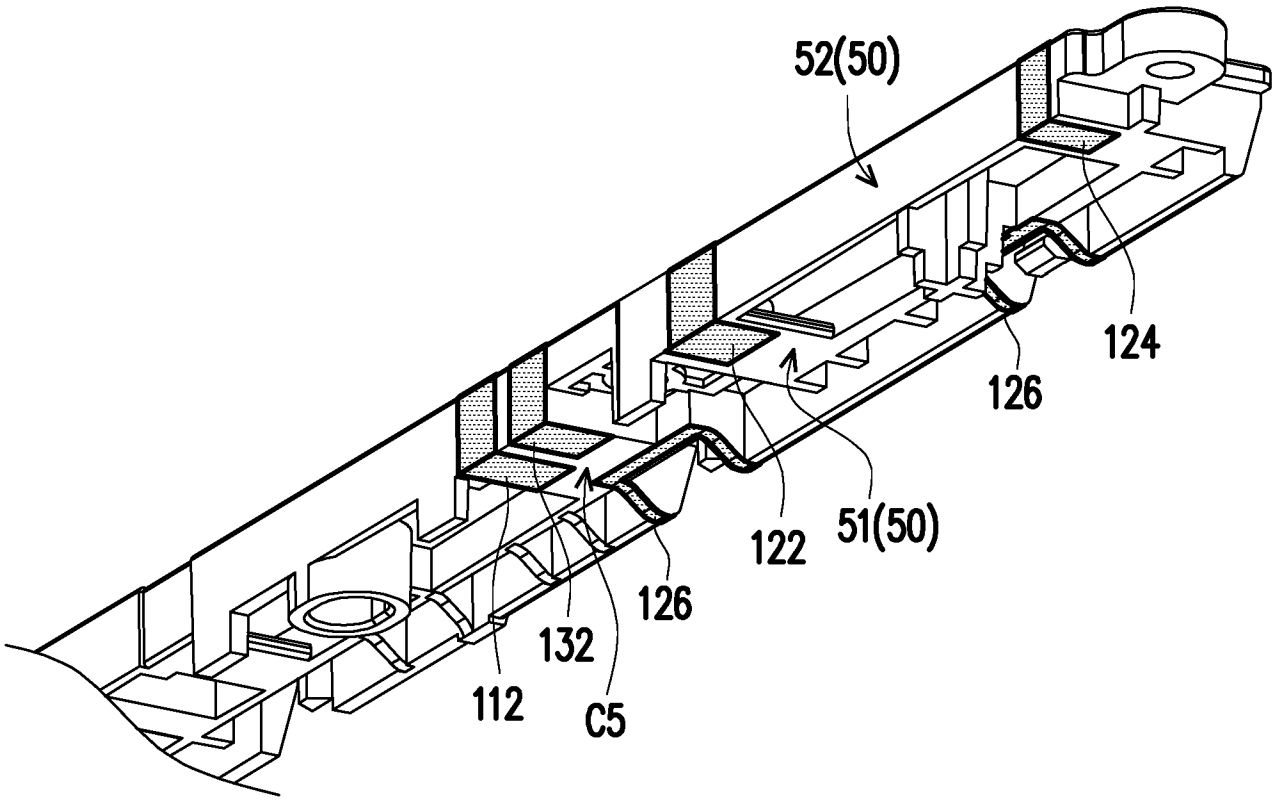
FIG. 2A to FIG. 2D are schematic three-dimensional diagrams illustrating the first radiator, the second radiator, and the third radiator in FIG. 1 are arranged on an insulating bracket at several view angles.

FIG. 1 is a schematic diagram of an unfolded antenna structure according to an embodiment of the disclosure. Referring to FIG. 1, an antenna structure 100 in the present embodiment includes a first radiator 110, a second radiator 120, and a third radiator 130. The first radiator 110, the second radiator 120, and the third radiator 130 may be disposed on a flexible substrate 105, and then coated on an insulating bracket 50 (FIG. 2A). Certainly, in an embodiment, the first radiator 110, the second radiator 120, and the third radiator 130 may also be formed on the insulating bracket 50 through laser direct structuring (LDS).

Figure 3:
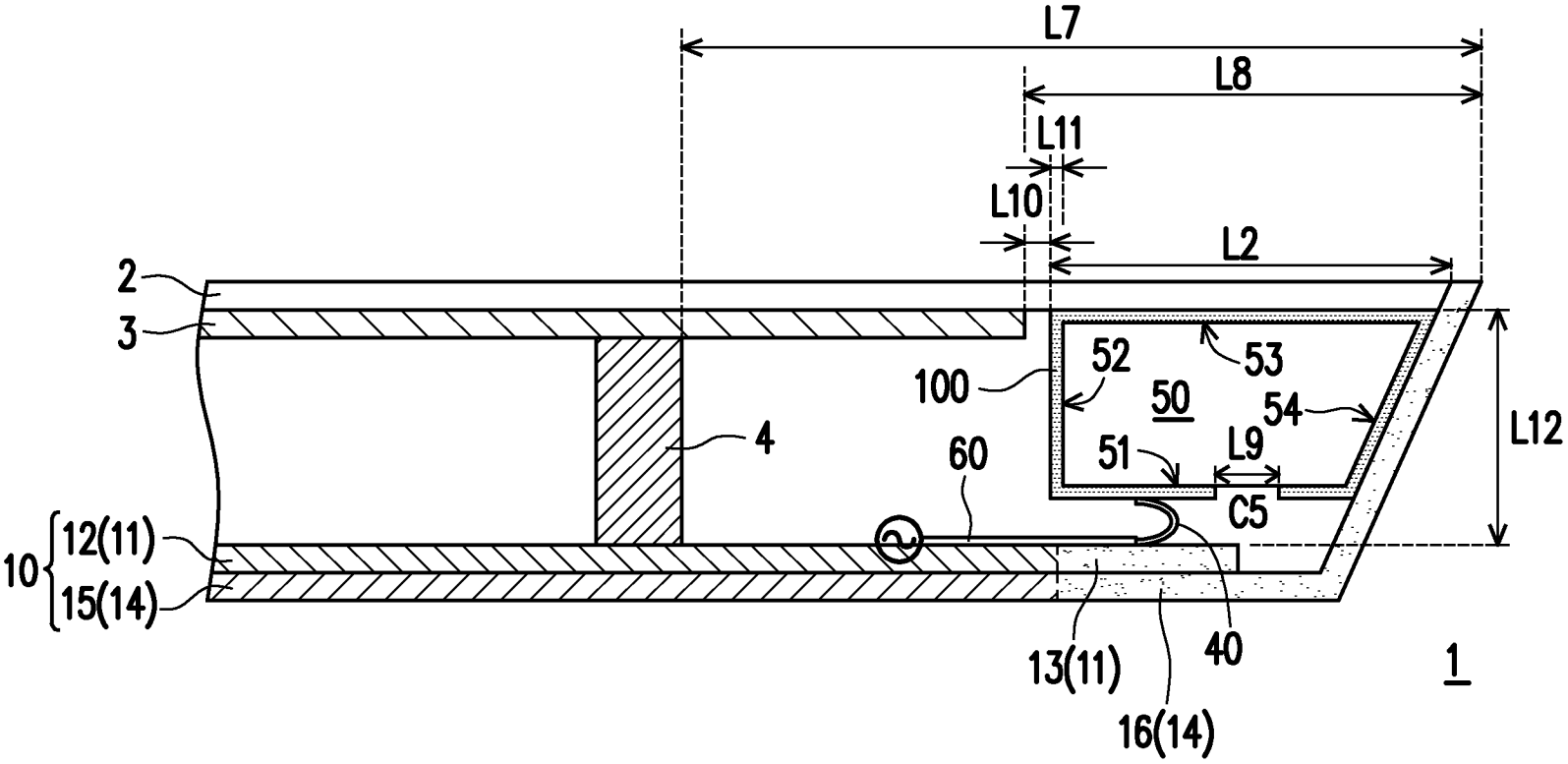
FIG. 3 is a schematic partial cross-sectional view of the antenna structure in FIG. 2A disposed in an electronic apparatus.

As shown in FIG. 1, in the present embodiment, the first radiator 110 includes a first segment 112 (positions A1, A2, and A3), a second segment 114 (positions A3 and A4), and a third segment 113 (positions A3, A5, A6, and A7). One end of the first segment 112 includes a signal feeding end (the position A1), and the second segment 114 and the third segment 113 extend in opposite directions from another end of the first segment 112. The signal feeding end (the position A1) is connected to a mainboard 11 via a coaxial transmission line 60 (FIG. 3). In the present embodiment, the second segment 114 extends leftward from the first segment 112 (the position A3), and the third segment 113 extends rightward from the first segment 112 (the position A3).

In the present embodiment, the third segment 113 of the first radiator 110 includes a first sub-segment 115 (the positions A3, A5, and A6), a second sub-segment 118 (the position A6), and a third sub-segment 119 (the position A7). In the present embodiment, the first sub-segment 115 includes a first part 116 (the positions A3 to A5) and a second part 117 (the positions A5 to A6). The first part 116 is connected to the second part 117, and the first part 116 and the second part 117 have different widths. The second sub-segment 118 is connected to the second part 117 in a bending manner, and the third sub-segment 119 is connected to the second sub-segment 118 in a bending manner.

As shown in FIG. 1, in the present embodiment, the second radiator 120 includes fourth segments 122 and 123 (positions G2, B2, and B4), a fifth segment 124 (positions G3, B3, and B4), and a sixth segment 121 (positions B4, B5, B6, B7, and B8) extending from an intersection (the position B4) of the fourth segment 123 and the fifth segment 124.

The fourth segment 122 is connected to the fourth segment 123 in a bending manner, and the fourth segment 122 and the fourth segment 123 have different widths. The fourth segment 122 includes a first ground end (the position G2), and the fifth segment 124 includes a second ground end (the position G3). The first ground end (the position G2) and the second ground end (the position G3) are away from the intersection (the position B4).

The sixth segment 121 of the second radiator 120 includes a fourth sub-segment 125 (the position B4), a fifth sub-segment 126 (the positions B5, B6, and B7), and a sixth sub-segment 129 (the position B8) sequentially connected in a being manner.

As shown in FIG. 1, the second segment 114 of the first radiator 110 is located beside the fifth sub-segment 126 (the position B7), and a first slit C1 is formed between the second segment 114 and the fifth sub-segment 126 (the position B7) of the sixth segment 121. In the present embodiment, the antenna structure 100 couples out two frequency bands of 698 MHz and a doubled frequency 1710 MHz by using a path of the first segment 112 and the second segment 114 of the first radiator 110 and a design of the second segment 120 (a path of the ground end) and the first slit C1 (a capacitive coupling gap). Certainly, in other embodiments, frequency bands of the antenna structure 100 are not limited thereto.

In addition, the second part 117 of the first sub-segment 115 of the third segment 113 of the first radiator 110 is located beside the fourth segment 123 of the second radiator 120, the second sub-segment 118 is located beside the fourth sub-segment 125 of the sixth segment 121, and the third sub-segment 119 is located beside the fifth sub-segment 126 (the positions B5 and B6) of the sixth segment 121 to form a second slit C2. The second slit C2 has a U shape with an opening facing left.

In the present embodiment, the antenna structure 100 resonates two frequency bands of 960 MHz and doubled frequency 1900 MHz by using the first segment 112 and the third segment 113 of the first radiator 110, the second segment 120 (the path of the ground end) through the second slit C2 (a capacitive coupling gap) whose U-shaped notch faces the left. In addition, the antenna structure 100 may adjust a 960 MHz impedance matching bandwidth and a resonance frequency point position through the second slit C2 between a path of the third segment 113 and the ground path and line widths of paths of the positions B4 and B5.

The third radiator 130 includes a seventh segment 132 (positions G1 and D1) and an eighth segment 134 (a position D2) connected in a bending manner. The seventh segment 132 includes a third ground end (the position G1), and a third slit C3 is formed between the first segment 112 of the first radiator 110 and the seventh segment 132 of the third radiator 130 and between the third segment 113 of the first radiator 110 and the eighth segment 134 of the third radiator 130. The third slit C3 has an inverted L shape.

In the present embodiment, the first segment 112 of the first radiator 110 of the antenna structure 100, the first part 116 of the first sub-segment 115 of the third segment 113, the third radiator 130, and the third slit C3 (a capacitive coupling gap) with an inverted L shape resonate a frequency band of 2300 MHz to 2700 MHz. In addition, the antenna structure 100 may adjust a 2300 MHz impedance matching bandwidth and a resonance frequency point position through the third slit C3 and a line width of the third radiator 130.

In addition, a width of the second segment 114 of the first radiator 110 is less than a width of the first segment 112, and a fourth slit C4 is formed between a part (the position A3) of the second segment 114 close to the first segment 112 and the first segment 112. The antenna structure 100 may adjust a 1710 MHz impedance matching bandwidth and a resonance frequency point position by adjusting a line width (paths of the positions A3 and A4) of the second segment 114 and the fourth slit C4.

In addition, the third ground end (the position G1) is close to the signal feeding end (the position A1), the second ground end (the position G3) is away from the signal feeding end (the position A1), the first ground end (the position G2) is located between the second ground end (the position G3) and the third ground end (the position G1), and the first ground end (the position G2), the second ground end (the position G3), and the third ground end (the position G1) are connected to a system ground plane 10.

In the present embodiment, the first ground end (the position G2) is connected in series to a first capacitor 30 and then connected to the system ground plane 10, and the second ground end (the position G3) is connected in series to a second capacitor 32 and then connected to the system ground plane 10. Such a design can be used to adjust a change of a low frequency of the antenna structure 100 in impedance matching to achieve low-frequency and wide-frequency characteristics. In the present embodiment, capacitance values of the first capacitor 30 and the second capacitor 32 each are 3.3 pF (a capacitance range is 2.7 pF to 4.7 pF), respectively, but the first capacitor 30 and the second capacitor 32 are not limited to thereto. In an embodiment not shown, the second ground end may also be connected to the system ground plane 10 through a tuning circuit (tuner).

In addition, the system ground plane 10 includes a specific absorption rate (SAR) sensing circuit 20 near the first ground end (the position G2) or the second ground end (the position G3), the SAR sensing circuit 20 being connected to the first ground end (the position G2) or the second ground end (the position G3) through a detection pin 22.

It is worth mentioning that, in order to comply with electromagnetic wave specifications, in a conventional antenna, a SAR sensing circuit is placed with an LTE main antenna, so that the LTE main antenna and the SAR sensing circuit form a hybrid antenna. The SAR sensing circuit can detect approaching of an object and reduce a transmission power in this case, to comply with a certification standard for SAR testing. However, the above design results in an overall large volume of the antenna and occupation of a relatively large antenna clearance area.

In the present embodiment, the antenna structure 100 is connected to the mainboard 11 through a ground path of the first ground end (the position G2) or the second ground end (the position G3), and an SAR sensing circuit 20 is designed on the mainboard 11, so that space of the antenna structure 100 can be reduced. In addition, according to actual measurement, in the present embodiment, arranging the SAR sensing circuit 20 on the mainboard 11 does not affect antenna characteristics of the antenna structure 100 at a low frequency.

In addition, the first radiator 110, the second radiator 120, and the third radiator 130 of the antenna structure 100 in the present embodiment may be attached to different surfaces of a three-dimensional structure in a bending manner. In the present embodiment, the sixth segment 121 (the positions B5, B6, and B7) of the second radiator 120 has a length L1 between 60 millimeters and 70 millimeters, for example, 65 millimeters. A width of the flexible substrate 105 consists of lengths L2, L3, L4, L5, and L6. The length L2 is between 8 millimeters and 10 millimeters, for example, 8.6 millimeters to 9 millimeters. The lengths L3 and L4 are between 2.5 millimeters and 5 millimeters, the length L3 is, for example, 4.3 millimeters, and the length L4 is, for example, 3 millimeters. A sum of the lengths L5 and L6 may be less than the length L2. It may be learned from the above values that the antenna structure 100 in the present embodiment has a pretty small size.

Figure 2B:
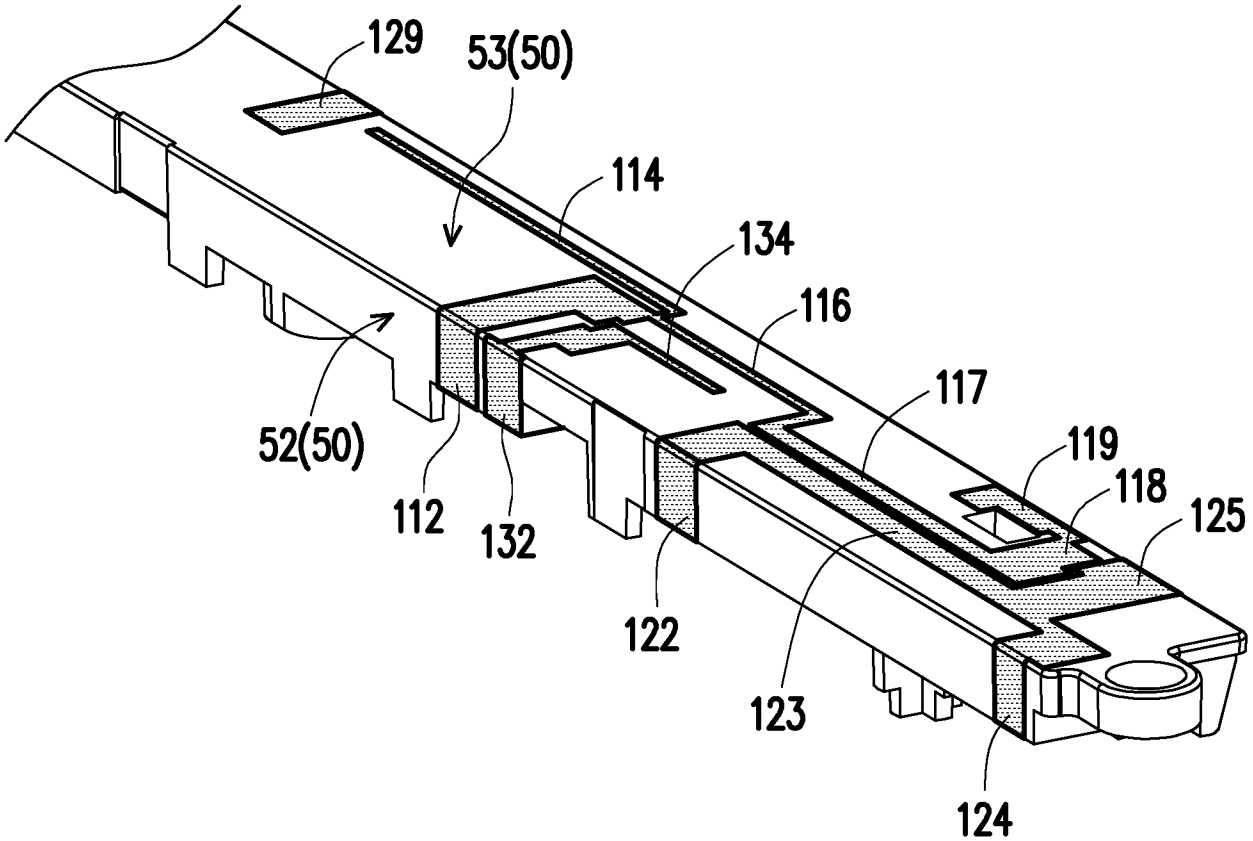
Figure 2C:
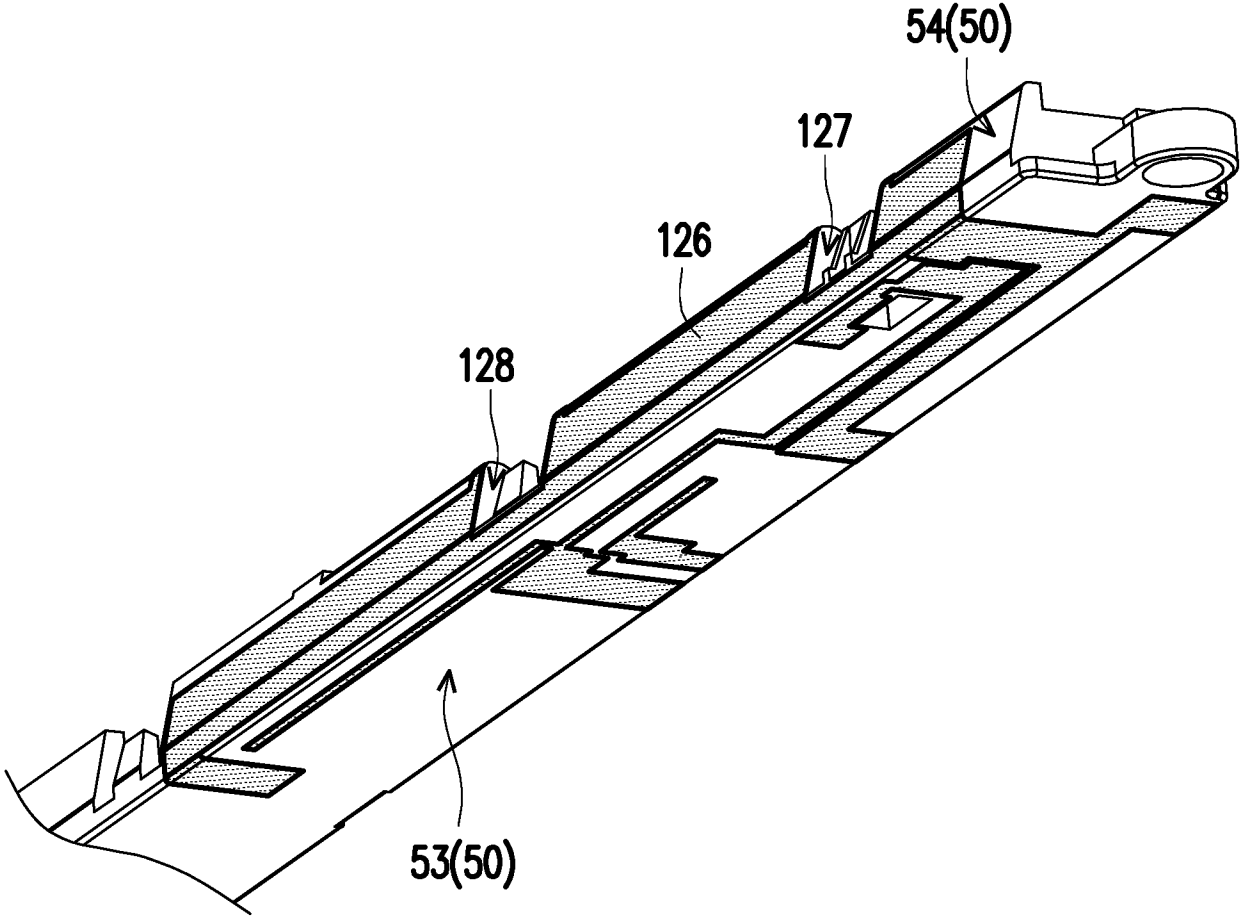
Figure 2D:
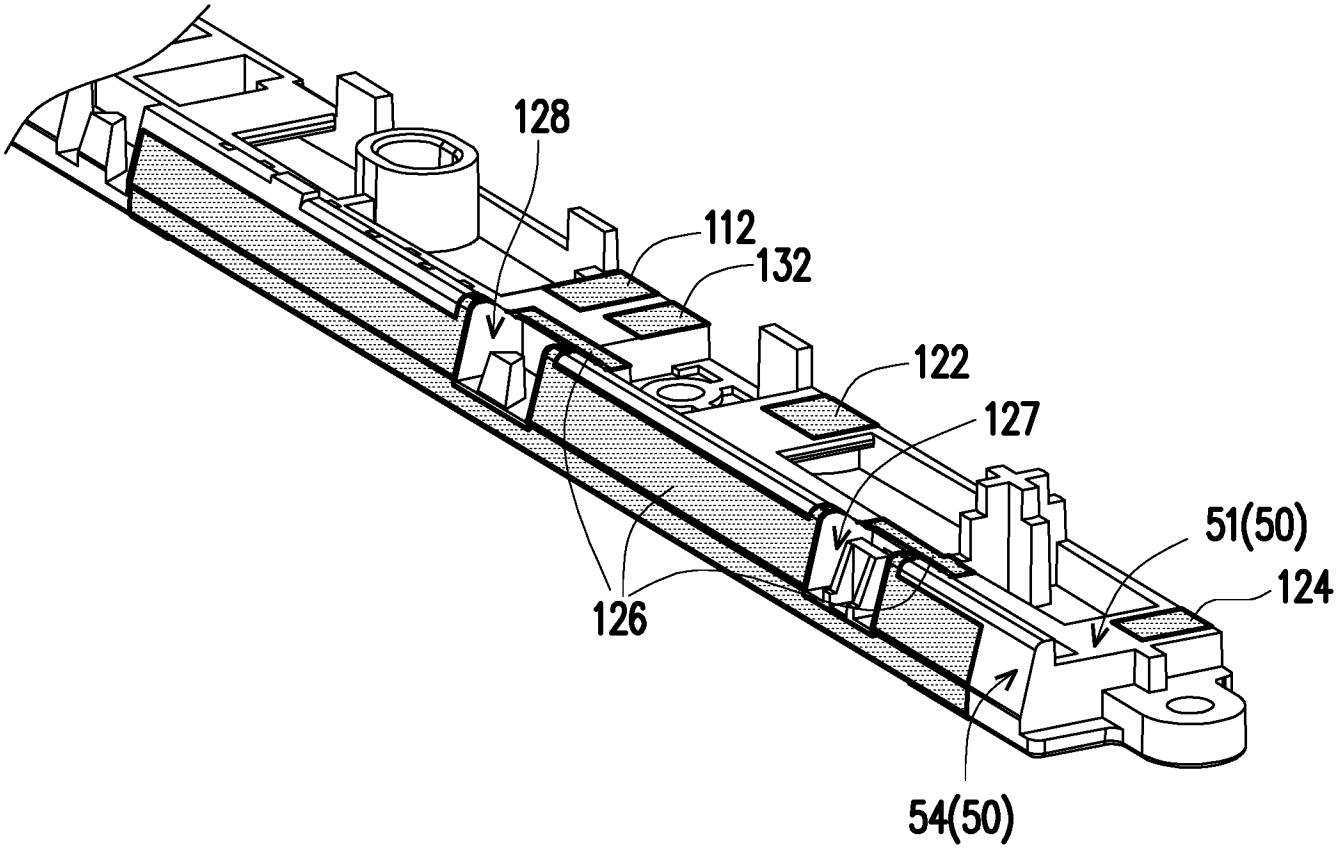

FIG. 2A to FIG. 2D are schematic three-dimensional diagrams illustrating the first radiator, the second radiator, and the third radiator in FIG. 1 are arranged on an insulating bracket at several view angles. Referring to FIG. 2A to FIG. 2D, the antenna structure 100 further includes an insulating bracket 50. In the present embodiment, the flexible substrate 105 is attached to the insulating bracket 50. The insulating bracket 50 has a length between 60 millimeters and 70 millimeters, a width between 8 millimeters and 10 millimeters, and a height between 4.5 millimeters and 5.5 millimeters. The insulating bracket 50 has a first long side surface 51 (FIG. 2A and FIG. 2D), a second long side surface 52 (FIG. 2A), a third long side surface 53 (FIG. 2B), and a fourth long side surface 54 (FIG. 2C).

In this embodiment, the first segment 112 includes three parts (a part, another part and the other part). The fourth segment 122 includes three parts (a part, another part and the other part). The fifth segment 124 includes three parts (a part, another part and the other part). The seventh segment 132 includes three parts (a part, another part and the other part).

Referring to 2A, a part of the first segment 112 of the first radiator 110, a part of the fourth segment 122 of the second radiator 120, a part of the fifth segment 124, a part (the fifth sub-segment 126) of the sixth segment 121, and a part of the seventh segment 132 of the third radiator 130 are arranged on the first long side surface 51.

On the first long side surface 51, the seventh segment 132 of the third radiator 130 extends inward from one side of the first long side surface 51, and the fifth sub-segment 126 of the sixth segment 121 extends inward from another side of the first long side surface 51. On the first long side surface 51, a coupling gap C5 is formed between the seventh segment 132 and the fifth sub-segment 126 of the sixth segment 121. The antenna structure 100 in the present embodiment can improve a low-frequency impedance bandwidth by adjusting the coupling gap C5.

In addition, referring to FIG. 2B, another part of the first segment 112 of the first radiator 110, another part of the fourth segment 122 of the second radiator 120, another part of the fifth segment 124, and another part of the seventh segment 132 of the third radiator 130 are arranged on the second long side surface 52.

In addition, the other part of the first segment 112, the second segment 114, the first part 116, the second part 117, the second sub-segment 118, and the third sub-segment 119 of the first radiator 110, the other part of the fourth segment 122 and the fourth segment 123, the other part of the fifth segment 124, and the fourth sub-segment 125 and the sixth sub-segment 129 of the sixth segment 121 of the second radiator 120, and the other of the seventh segment 132 of the third radiator 130 and the eighth segment 134 are arranged on the third long side surface 53.

Referring to FIG. 2C, another part of the fifth sub-segment 126 of the sixth segment 121 of the second radiator 120 is arranged on the fourth long side surface 54. In addition, referring to FIG. 1 and FIG. 2D, in the present embodiment, the fifth sub-segment 126 of the sixth segment 121 of the second radiator 120 has two holes 127 and 128 (positions E1 and E2). This is because when the antenna structure 100 is disposed on the insulating bracket 50, positions corresponding to the two holes 127 and 128 are two hooks. In other embodiments, the holes 127 and 128 on the fifth sub-segment 126 may also be omitted if there is no need to make a structural compromise.

The antenna structure 100 in the present embodiment is grounded in a multi-path manner through the first ground end, the second ground end, and the third ground end, and in combination with the capacitive coupling design of the first slit C1, the second slit C2, the third slit C3, the fourth slit C4, and the coupling gap C5, low-frequency support of 698 MHz to 960 MHz, high-frequency support of 1710 MHz to 2700 MHz, and 5G high frequency support of 3300 MHz to 3800 MHz and 5150 MHz to 5925 MHz can be achieved without designing a switching circuit.

FIG. 3 is a schematic partial cross-sectional view of the antenna structure in FIG. 2A disposed in an electronic apparatus. Referring to FIG. 3, in the present embodiment, an electronic apparatus 1 is a touch-sensitive electronic apparatus, for example. However, a type of the electronic apparatus 1 is not limited thereto. The electronic apparatus 1 includes a glass plate 2, a back cover 14, a screen metal area 3, an antenna structure 100, a mainboard 11, and a metal wall 4. The screen metal area 3 is disposed on an inner surface of the glass plate 2, and the mainboard 11 is disposed on an inner surface of the back cover 14. The antenna structure 100 is disposed in the electronic apparatus 1 near an edge.

The back cover 14 includes a back cover metal area 15 and a back cover insulating area 16. The back cover insulating area 16 is, for example, a plastic window. The mainboard 11 includes a mainboard ground plane 12 and a mainboard insulating area 13. The back cover insulating area 16 and the mainboard insulating area 13 correspond to the antenna structure 100. The system ground plane 10 consists of the mainboard ground plane 12 and the back cover metal area 15. The signal feeding end (the position A1) of the antenna structure 100 is connected to the coaxial transmission line 60 through an elastic piece 40. In a cross section not shown, the ground end of the antenna structure 100 may be connected to the mainboard ground end 12 of the main board 11 through other elastic pieces.

The metal wall 4 is arranged beside the antenna structure 100 to improve antenna efficiency and system grounding stability, so as to not only prevent a signal on the mainboard 11 from affecting an antenna signal, but also connect the screen metal area 3 and the mainboard ground plane 12. In the present embodiment, a distance L7 between the metal wall 4 and the edge of the electronic apparatus 1 is between 15 millimeters and 20 millimeters, for example, 17 millimeters. In the present embodiment, the metal wall 4 is a conductive foam with a width of 3 millimeters, but the metal wall 4 is not limited thereto.

A distance L8 between the screen metal area 3 and the edge of the electronic apparatus 1 is between 10 millimeters and 13 millimeters, for example, 11.3 millimeters. A length L9 of a coupling gap on the first long side surface 51 of the antenna structure 100 is, for example, between 1.5 millimeters and 3.5 millimeters. A distance L10 between the screen metal area 3 and the antenna structure 100 is between 0.5 millimeters and 1.5 millimeters, for example, 0.8 millimeters.

On the third long side surface 53, a distance L11 between the radiator and an edge of the third long side surface 53 is between 0.3 millimeters and 0.5 millimeters, for example, 0.4 millimeters. In the present embodiment, an overlap distance between an ITO circuit of a touch screen and the antenna structure 100 is the distance L11. The radiator of the antenna structure 100 may be specially designed to avoid the distance, and only an area (for example, an area with a length of 8.6 millimeters) with a length L2 (for example, 9 millimeters) minus the distance L11 (for example, 0.4 millimeters) is used.

In addition, a distance L12 between the top surface of the antenna structure 100 and the mainboard 11 is between 4 millimeters and 6 millimeters, for example, 5.1 millimeters. In addition, according to actual measurement, in an embodiment, when the antenna structure 100 and a Wi-Fi antenna (not shown) are 15 millimeters, isolation between the two is −15 dB, and therefore achieves good performance. It should be noted that the above dimensions are merely one of the implementations, and the disclosure is not limited thereto in fact.

Figure 4:
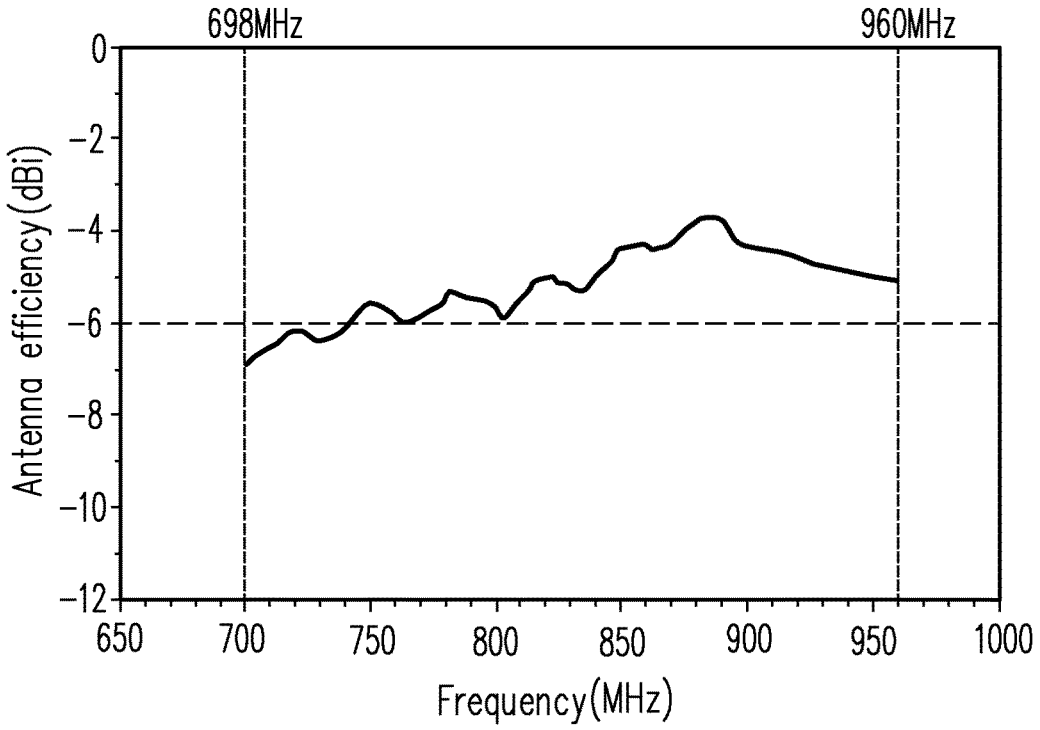
FIG. 4 illustrates a frequency (698 MHz to 960 MHz)-antenna efficiency relationship of the antenna structure in FIG. 2A.
Figure 5:
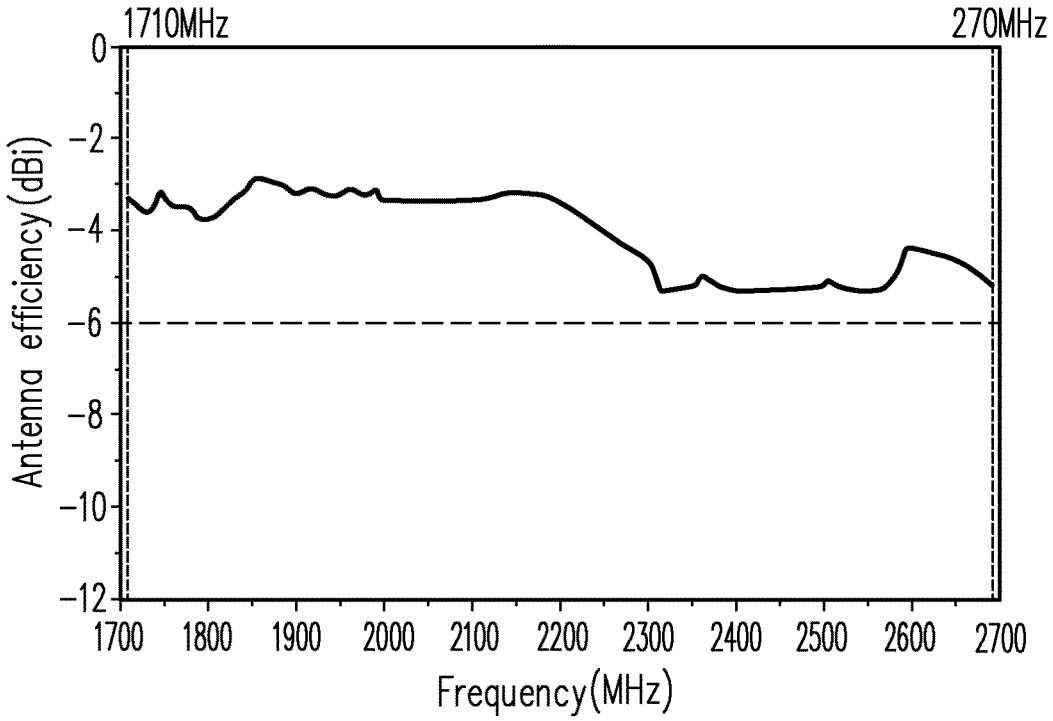
FIG. 5 illustrates a frequency (1710 MHz to 2700 MHz)-antenna efficiency relationship of the antenna structure in FIG. 2A.

FIG. 4 illustrates a frequency (698 MHz to 960 MHz)-antenna efficiency relationship of the antenna structure in FIG. 2A. Referring to FIG. 4, in the present embodiment, the antenna structure 100 has antenna efficiency between −3.6 dBi and −6.9 dBi at a frequency of 698 MHz to 960 MHz, and therefore achieves good performance. FIG. 5 illustrates a frequency (1710 MHz to 2700 MHz)-antenna efficiency relationship of the antenna structure in FIG. 2A. Referring to FIG. 5, in the present embodiment, the antenna structure 100 has antenna efficiency of −2.9 dBi to −5.3 dBi at a frequency of 1710 MHz to 2700 MHz.

It is worth mentioning that the antenna structure 100 in the present embodiment has antenna efficiency of −4.7 dBi to −6.9 dBi at a frequency of 3300 MHz to 3800 MHz and antenna efficiency from −3.2 dBi to −5.6 dBi at a frequency of 5150 MHz to 5925 MHz. Therefore, the antenna structure 100 can achieve broadband antenna characteristics and has LTE broadband antenna efficiency without using a switching circuit.

Figure 6:
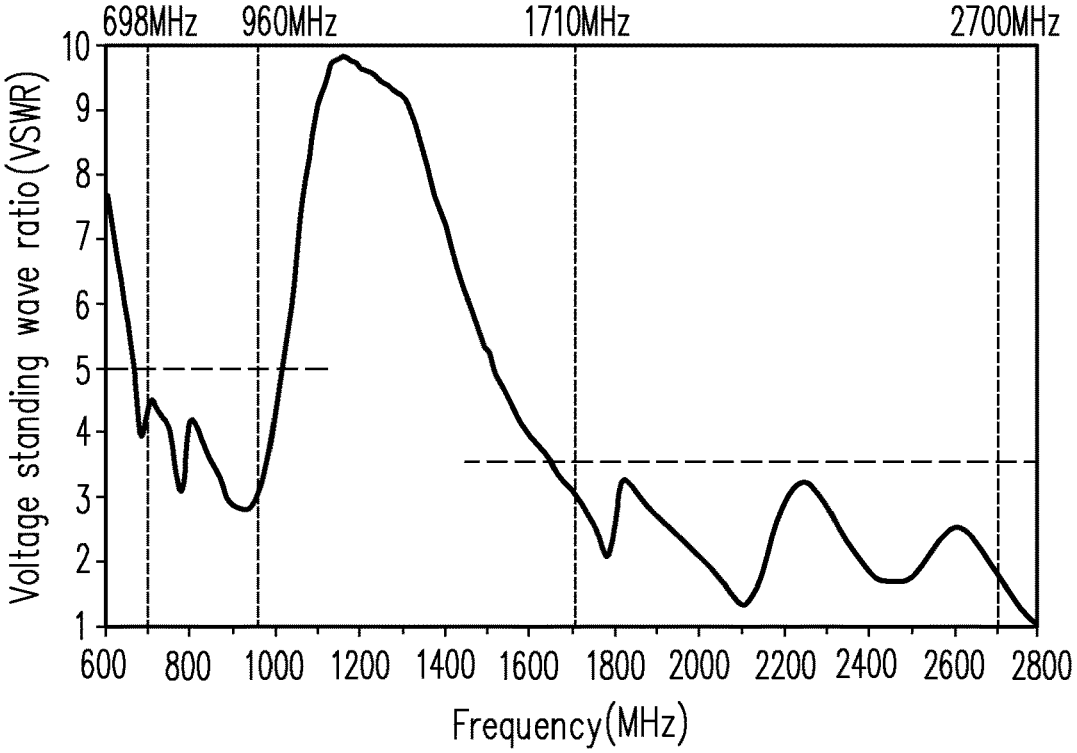
FIG. 6 illustrates a frequency (698 MHz to 2700 MHz)-voltage standing wave ratio (VSWR) relationship of the antenna structure in FIG. 2A.

FIG. 6 illustrates a frequency (698 MHz to 2700 MHz)-VSWR relationship of the antenna structure in FIG. 2A. Referring to FIG. 6, in the present embodiment, the antenna structure 100 can have a VSWR less than or equal to 5 at a frequency of 698 MHz to 960 MHz, and a VSWR less than 3.5 at a frequency of 1710 MHz to 2700 MHz, and therefore achieves good performance.

Figure 7:
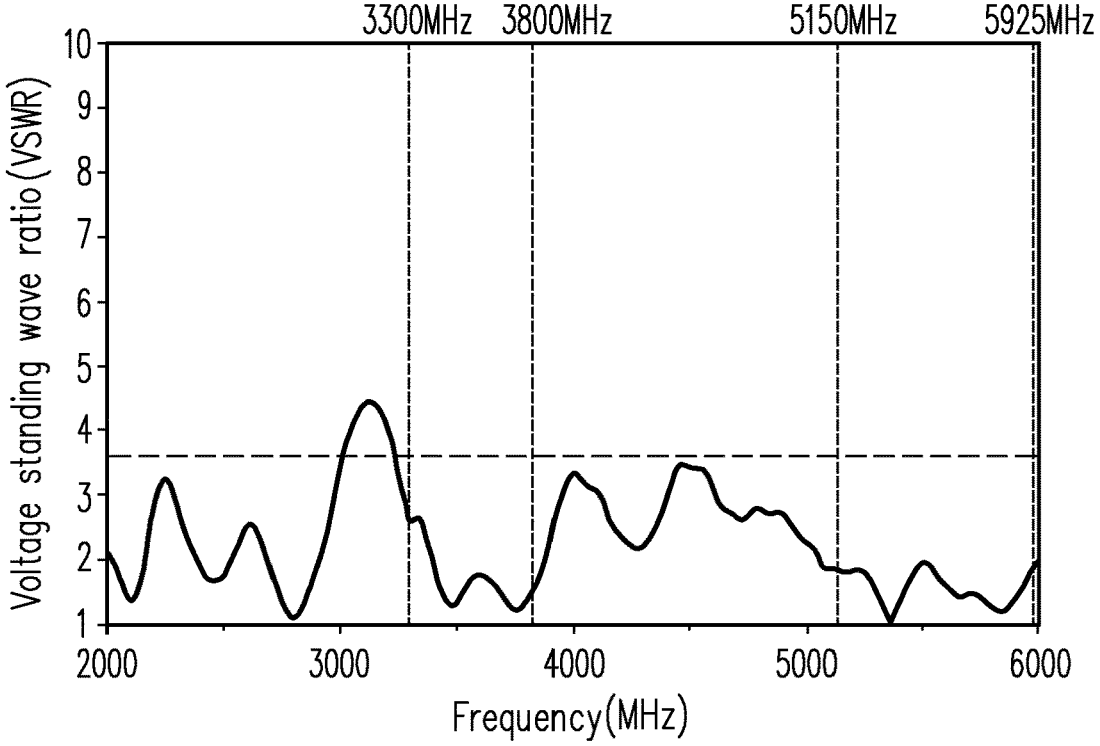
FIG. 7 illustrates a frequency (3300 MHz to 5925 MHz)-VSWR relationship of the antenna structure in FIG. 2A.

FIG. 7 illustrates a frequency (3300 MHz to 5925 MHz)-VSWR relationship of the antenna structure in FIG. 2A. Referring to FIG. 7, in the present embodiment, the antenna structure 100 may have a VSWR less than 3.5 at both a frequency of 3300 MHz to 3800 MHz and a frequency of 5150 MHz to 5925 MHz, and therefore achieves good performance.

To sum up, the antenna structure provided in one or more embodiments of the disclosure is grounded in a multi-path manner through the first ground end, the second ground end, and the third ground end, and in combination with the capacitive coupling design of the first slit, the second slit, the third slit, the fourth slit, and the coupling gap, low frequency support of 698 MHz to 960 MHz, high frequency support of 1710 MHz to 2700 MHz, and 5G high frequency support of 3300 MHz to 3800 MHz and 5150 MHz to 5925 MHz can be achieved without designing a switching circuit, so as to comply with the requirements for the multi-band antenna.

Although the disclosure has been disclosed in the above embodiments, the embodiments are not intended to limit the disclosure. It will be apparent to persons skilled in the art that various modifications and variations can be made to the disclosed embodiments without departing from the scope or spirit of the disclosure. In view of the foregoing, it is intended that the disclosure cover modifications and variations provided that they fall within the scope of the following claims and their equivalents.

What is claimed is:

1. An antenna structure, comprising:

a first radiator, comprising a first segment, a second segment, and a third segment, wherein one end of the first segment comprises a signal feeding end, and the second segment and the third segment extend in opposite directions from another end of the first segment;

a second radiator, comprising a fourth segment, a fifth segment, and a sixth segment, the sixth segment extending from an intersection of the fourth segment and the fifth segment, wherein the fourth segment comprises a first ground end, the fifth segment comprises a second ground end, the first ground end and the second ground end are away from the intersection, a first slit is formed between the second segment and the sixth segment, and a second slit is formed among the third segment, the fourth segment, and the sixth segment; and a third radiator, comprising a seventh segment and an eighth segment connected to each other in a bending manner, wherein the seventh segment comprises a third ground end, and a third slit is formed between the first segment and the seventh segment and between the third segment and the eighth segment.

2. The antenna structure according to claim 1, wherein the third segment of the first radiator comprises a first sub-segment, a second sub-segment, and a third sub-segment connected in a bending manner, and the first sub-segment, the second sub-segment, and the third sub-segment are located beside the fourth segment and the sixth segment, so that the second slit has a U shape.

3. The antenna structure according to claim 2, wherein the sixth segment of the second radiator comprises a fourth sub-segment, a fifth sub-segment, and a sixth sub-segment connected in a bending manner, the second sub-segment and the third sub-segment are located beside the fourth sub-segment and the fifth sub-segment, respectively, and the second segment of the first radiator is located beside the fifth sub-segment.

4. The antenna structure according to claim 1, wherein a width of the second segment is less than a width of the first segment, and a fourth slit is formed between the first segment and a portion of the second segment close to the first segment.

5. The antenna structure according to claim 1, further comprising an insulating bracket having a first long side surface, a second long side surface, a third long side surface, and a fourth long side surface, wherein a part of the first segment of the first radiator, a part of the fourth segment of the second radiator, a part of the fifth segment of the second radiator, a part of the sixth segment of the second radiator, and a part of the seventh segment of the third radiator are arranged on the first long side surface, another part of the first segment of the first radiator, another part of the fourth segment of the second radiator, another part of the fifth segment of the second radiator, and another part of the seventh segment of the third radiator are arranged on the second long side surface, the other part of the first segment of the first radiator, the second segment of the first radiator, the third segment of the first radiator, the other part of the fourth segment of the second radiator, the other part of the fifth segment of the second radiator, another part of the sixth segment of the second radiator, the other part of the seventh segment of the third radiator, and the eight segment of the third radiator are located on the third long side surface, and the other part of the sixth segment of the second radiator is located on the fourth long side surface.

6. The antenna structure according to claim 5, wherein on the first long side surface, the one part of the seventh segment of the third radiator extends inward from one side of the first long side surface, the one part of the sixth segment extends inward from the other side of the first long side surface, and a coupling gap is formed between the seventh segment and the sixth segment on the first long side surface.

7. The antenna structure according to claim 5, wherein a length of the insulating bracket is between 60 millimeters and 70 millimeters, a width of the insulating bracket is between 8 millimeters and 10 millimeters, and a height of the insulating bracket is between 4.5 millimeters and 5.5 millimeters.

8. The antenna structure according to claim 1, wherein the third ground end is close to the signal feeding end, the second ground end is away from the signal feeding end, the first ground end is located between the second ground end and the third ground end, and the first ground end, the second ground end, and the third ground end are connected to a system ground plane.

9. The antenna structure according to claim 8, wherein the first ground end is connected in series to a first capacitor and then connected to the system ground plane.

10. The antenna structure according to claim 8, wherein the second ground end is connected in series to a second capacitor or a tuner and then connected to the system ground plane.

11. The antenna structure according to claim 8, wherein the system ground plane comprises a specific absorption rate sensing circuit close to the first ground end or the second ground end, and the specific absorption rate sensing circuit is connected to the first ground end or the second ground end through a detection pin.

* * * * *